US006308442B1

(12) United States Patent
Naka et al.

(10) Patent No.: US 6,308,442 B1
(45) Date of Patent: Oct. 30, 2001

(54) WORKING MACHINE ATTACHMENT ATTACHING AND DETACHING DEVICE

(75) Inventors: Tadahiro Naka, Tatsukuchi-machi; Naoyuki Sakurai, Komatsu, both of (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/434,056

(22) Filed: Nov. 4, 1999

(30) Foreign Application Priority Data

Nov. 9, 1998 (JP) ..... 10-334976

(51) Int. Cl.[7] ..... E02F 3/96
(52) U.S. Cl. ..... 37/468; 403/322.1; 414/723
(58) Field of Search ..... 137/468, 403, 137/404, 405, 406, 407, 408, 409, 410; 414/912, 723; 403/322.1, 322.3

(56) References Cited

U.S. PATENT DOCUMENTS 5,082,389 * 1/1992 Balemi ..... 403/322
5,456,030 * 10/1995 Barone et al. ..... 37/468
5,581,917 * 12/1996 Barden ..... 37/468
5,692,325 * 12/1997 Kuzutani ..... 37/468
6,042,295 * 3/2000 Barden ..... 403/158
6,058,633 * 5/2000 Barden ..... 37/468
6,132,131 * 10/2000 Nakamura et al. ..... 403/322.1

FOREIGN PATENT DOCUMENTS 3030543 8/1996 (JP) .

* cited by examiner

*Primary Examiner*—Victor Batson
(74) *Attorney, Agent, or Firm*—Armstrong, Westerman, Hattori, McLeland & Naughton, LLP

(57) ABSTRACT

A device which includes a first member rotatable around the forward end of a working machine arm by a hydraulic cylinder and a second member hanging down at the forward end of the first member. A third cross-pin of an attachment is freely engaged in the vicinity of a basic end of the first member, and a fourth cross-pin of an attachment is freely engaged at a forward end of the second member. The second member includes a hook, which is connected near its center, between a pair of plates, each having a recessed portion, by a fifth cross-pin. The hook is formed into an almost L-shape, divided from the position of the fifth cross-pin into an upper portion and a lower portion. The upper portion is a spindle portion having a second horizontal through-hole for inserting a stop pin, the lower portion is a hook body opening to both the recessed portions. The hook is formed in such a manner that the lower face of the spindle portion partly protrudes into both the recessed portions. The hook body opens to both the recessed portions and fully opens the recessed portions when the hook is balanced rotationally around the fifth cross-pin by its own weight.

5 Claims, 6 Drawing Sheets

WORKING MACHINE ATTACHMENT ATTACHING AND DETACHING DEVICE

TECHNICAL FIELD

The present invention relates to a working machine attachment attaching and detaching device.

BACKGROUND ART

Construction machines such as a hydraulic excavator, a wheel loader, and the like are widely used for work such as gravel or earth digging, road work, farm land consolidation, land creation, water and sewage work, construction foundation work, and the like. In order to carry out the above work with a small number of construction machines, the hydraulic excavator, for example, is interchangeably (that is, attachably and detachably) provided with various kinds of working machine attachments such as various kinds of buckets, a hydraulic breaker, a crusher, and the like. Moreover, a working machine attachment attaching and detaching device called a so-called quick coupler is used to enhance attachment and detachment efficiency.

Although there are various kinds of working machine attachment attaching and detaching devices, the technology described in Japanese Utility Model Bulletin No. 3030543 is the nearest to the present invention. Specifically, as an outline thereof is shown in FIG. 8, "A working machine attachment attaching and detaching device includes a first member 1 and a second member 2. The first member 1, the basic end of which is connected to the forward end of a working machine arm 3 with a first cross-pin P1, is rotatable around the first cross-pin P1 by extension and contraction of a hydraulic cylinder 4. Meanwhile, the second member 2, the basic end of which is connected to the forward end of the first member 1 with a second cross-pin P2, hangs downward. Moreover, with respect to a third cross-pin P3 and a fourth cross-pin P4 each provided in a working machine attachment 5 such as a bucket, breaker, or the like, the first member 1 has a hook 6 with a rotary cap 6*a* for engaging with the third cross-pin P3 and covering it with the cap near the basic end thereof, and the second member 2 has a hook 7 with a rotary cap 7*a* for engaging with the fourth cross-pin P4 and covering it with the cap at the forward end thereof." is described.

The above prior art, however, has the following disadvantages.

(1) The hooks 6 and 7 are complicated since they have many parts and mechanisms composing the rotary caps 6*a* and 7*a* in narrow spaces. As a result, costs are increased, and durability including rain proof, rust proof, vibration proof, and the like is insufficient for construction equipment which operates in harsh environments. Hence, there is the possibility that the rotary caps 6*a* and 7*a*, for example, will not rotate due to rusting, earth and sand caught in the caps, or the like.

(2) The hook 7 opens transversely. Therefore, it is required to previously rotate the second member 2 leftward as illustrated by some means such as manual work or the like and hold it prior to the engagement of the fourth cross-pin P4. Further, in the engagement of the fourth cross-pin P4, it is necessary to rotate the second member 2 by some means such as manual work or the like to engage the fourth cross-pin P4. After all, automatic engagement can not be attained by a share performed by the above manual work.

(3) In the attachment and detachment operation of the working machine attachment 5, generally the operation during engagement (namely, during "attachment") requires more careful handling and more time than the operation during disengagement (namely, during "detachment"). In engagement, as shown in FIG. 9A, with respect to a pin which is engaged first (the third cross-pin P3 in this example) out of the third and fourth pins P3 and P4, the degree of freedom for its alignment is high. Accordingly, even in the conventional method in which the third cross-pin P3 is driven into a pin boss, for example, attachment and detachment efficiency never drops greatly. Meanwhile, as shown in FIG. 9B, with respect to a pin which is engaged later (the fourth cross-pin P4 in this example), the degree of freedom for its alignment is reduced because the third cross-pin P3 is engaged first, thereby making its alignment difficult. Namely, if at least the fourth cross-pin which is engaged later is not easy to align, attachment and detachment efficiency drops greatly. However, the hooks 6 and 7 in the above prior art have the rotary caps 6*a* and 7*a* respectively. In the case of the small-sized working machine attachment 5, when the engagement of the third cross-pin P3 engaged first is performed only by manual work, higher attachment and detachment efficiency can be often obtained. In other words, the hooks in the prior art are superfluous and costly for the small-sized working machine attachment 5.

SUMMARY OF THE INVENTION

In view of the aforesaid conventional disadvantages, an object of the present invention is to provide a working machine attachment attaching and detaching device capable of attaining any one or some of simple structure, low cost, high durability, automatic engagement, facilitation of alignment in insertion of a pin regardless of the size of a working machine attachment.

To attain the above object, if explained mainly with reference to FIG. 1A, for example, [It should be noted that a numeral and symbol of each component is given in ( )], a first configuration of a working machine attachment attaching and detaching device according to the present invention is a working machine attachment attaching and detaching device including a first member (1) and a second member (2), the first member (1) the basic end of which is connected to the forward end of a working machine arm (3) with a first cross-pin (P1) being rotatable around the first cross-pin (P1) by extension and contraction of a hydraulic cylinder (4), the second member (2) the basic end of which is connected to the forward end of the first member (1) with a second cross-pin (P2) hanging downward, and with respect to a third cross-pin (P3) and a fourth cross-pin (P4) each provided in a working machine attachment (5) such as a bucket, breaker, or the like, the first member (1) being free to engage with the third cross-pin (P3) in the vicinity of the basic end thereof, and the second member (2) being free to engage with the fourth cross-pin (P4) at the forward end thereof, characterized by including a stop pin (P7), and characterized in that the second member (2) is provided with a pair of side plates (2R, 2L) disposed opposite to each other in a transverse direction and has an integral configuration, each of the side plates (2R, 2L) has a first horizontal thorough-hole (2RH, 2LH) for inserting the stop pin (P7), a recessed portion (8) provided with a front and rear slant faces (2FF, 2BB) the opening space of which widens more toward the forward ends, and a hook (9A) almost the center of which is connected with a fifth cross-pin (P5) between both the side plates (2R, 2L), the hook (9A) bends at a pin connecting portion with the fifth cross-pin (P5), being divided into an upper portion and a lower portion and formed almost into an L-shape, the upper potion being a spindle portion (9*u*) having a second horizontal through-hole (9H) for inserting the stop pin (P7), the lower portion being a hook body (9*d*) which opens to both the recessed portions (8, 8) side, and the almost L-shape being formed in such a manner that the lower face of the spindle portion (9*u*) partly protrudes from the bottoms of both the recessed portions (8, 8) and that the hook body (9*d*) opens to both the recessed portions (8, 8) side while fully opening the apertures of both the recessed portions (8, 8) when the hook (9A) is balanced rotationally around the fifth cross-pin (PS) by its own weight, and in that the first and second members (1, 2) and the first and second horizontal through-holes (2RH, 2LH, 9H) are set to have a relationship in which the fourth cross-pin (P4) is located nearly beneath both the recessed portions (8, 8) when the third cross-pin (P3) is engaged in the vicinity of the basic end of the first member (1), and a relationship in which after the engagement of the third cross-pin (P3), the hydraulic cylinder (4) is extended, this extension allowing the fourth cross-pin (P4) to abut on either of the front or rear slant faces (2FF, 2BB) and slide up the same to approach the bottoms of both the recessed portions (8, 8) and at the same time to abut on the lower face of the spindle portion (9*u*) to boost the same, this boost causing the rotation of the hook (9A) around the fifth cross-pin (P5), this rotation yielding the hook body (9*d*) to enclose the fourth cross-pin (P4) from the lower sides of both the recessed portions (8, 8), as the result of these boost and enclosure, the fourth cross-pin (P4) being put among the front and the rear slant faces (2FF, 2BB) and the inner face of the hook body (9*d*), at which time the stop pin (P7) is inserted into the first and second horizontal through-holes (2RH, 2LH, 9H), this insertion permitting the hook (9A) to be fixed to the second member (2), thereby engaging with the fourth cross-pin (P4) at the forward end of the second member (2).

According to the above first configuration, the following operational effects are obtained. It should be noted that "( )" is omitted with regard to the numeral and symbol of each of the above components.

i) The second member 2 has both the recessed portions 8 and 8 opening downward and hangs downward. Therefore, the mere extension of the hydraulic cylinder 4 enables the fourth cross-pin P4 located beneath both the recessed portions 8 and 8 to be introduced into both the recessed portion 8 and 8, thus smoothly performing automatic engagement.

ii) Both the recessed portions 8 and 8 each have the front and rear slant faces 2FF and 2BB. Accordingly, when the distance between the third and fourth cross-pins P3 and P4 is short, the fourth cross-pin P4 slides up the rear slant faces 2BB, and on the contrary, when the distance is long, the fourth cross-pin P4 slides up the front slant faces 2FF. Thus, even the working machine attachment 5 with the distance between the third and fourth cross-pins P3 and P4 being somewhat different can be interchanged.

iii) The hook 9A is configured not as a rotary cap but completely as a strengthening member. Therefore, it has high strength. The hook 9A also has a simple structure of being connected only with the fifth cross-pin PS and the stop pin P7, thus enabling low cost and excellent durability including rain proof, rust proof, vibration proof, and the like even for construction equipment which operates in harsh environments, and eliminating possibility that the hook will not rotate due to rusting, earth and sand caught in the hook.

iv) Since the fourth cross-pin P4 is a pin which is engaged later, even if the degree of freedom for its alignment is reduced because the third cross-pin P3 is engaged first, the operational effect in the aforesaid (i) is suitably obtained. In other words, attachment and detachment efficiency is high. Specially for the small-sized working machine attachment 5, the device is not excessively equipped, thus lowering costs.

Specifically, according to the above first configuration, a working machine attachment attaching and detaching device capable of attaining simple structure, low cost, high durability, automatic engagement, facilitation of alignment of a pin engaged later regardless of the size of a working machine attachment can be obtained.

If explained mainly with reference to FIG. 6A, for example, [It should be noted that a numeral and symbol of each component is given in ( )], a second configuration of a working machine attachment attaching and detaching device according to the present invention is a working machine attachment attaching and detaching device including a first member (1) and a second member (2), the first member (1) the basic end of which is connected to the forward end of a working machine arm (3) with a first cross-pin (P1) being rotatable around the first cross-pin (P1) by extension and contraction of a hydraulic cylinder (4), the second member (2) the basic end of which is connected to the forward end of the first member (1) with a second cross-pin (P2) hanging downward, and with respect to a third cross-pin (P3) and a fourth cross-pin (P4) each provided in a working machine attachment (5) such as a bucket, breaker, or the like, the first member (1) being free to engage with the third cross-pin (P3) in the vicinity of the basic end thereof, and the second member (2) being free to engage with the fourth cross-pin (P4) at the forward end thereof, characterized by including a stop pin (P7), and characterized in that the second member (2) is provided with a pair of side plates (2R, 2L) disposed opposite to each other in a transverse direction and has an integral configuration, each of said side plates (2R, 2L) has a first horizontal thorough-hole (2RH, 2LH) for inserting the stop pin (P7), a recessed portion (8) provided with a front and rear slant faces (2FF, 2BB) the opening space of which widens more toward the forward ends, and a hook (9B) the upper end of which is connected with a sixth cross-pin (P6) between both the side plates (2R, 2L), the hook (9B) opens to both the recessed portions (8, 8) side, and in that the hook (9B), the first horizontal through-holes (2RH, 2LH), and the sixth cross-pin (P6) are set to have a relationship in which the apertures of both the recessed portions (8, 8) fully open when the hook (9B) is mounted on the stop pin (P7) inserted in the first horizontal through-holes (2RH, 2LH), a relationship in which the fourth cross-pin (P4) is located nearly beneath both the recessed portions (8, 8) when the third cross-pin (P3) is engaged near the basic end of the first member (1) while the hook (9B) is mounted on the stop pin (P7), and a relationship in which after the engagement of the third cross-pin (P3), the hydraulic cylinder (4) is extended, this extension allowing the fourth cross-pin (P4) to abut on either of the front or rear slant faces (2FF, 2BB) of both the recessed portions (8, 8) and slide up the same, the stop pin (P7) being pulled out of the first horizontal through-holes (2RH, 2LH) when the fourth cross-pin (P4) abuts on both the front and rear slant faces (2FF, 2BB), thereafter the hook (9B) being rotated around the sixth cross-pin (P6), the stop pin (P7) being reinserted into the first horizontal through-holes (2RH, 2LH) when the inner face of the hook (9B) abuts on the lower face of the fourth cross-pin (P4), and this reinsertion permitting the hook (9B) to be fixed to the second member (2), thereby engaging with the fourth cross-pin (P4) at the forward end of the second member (2).

According to the second configuration, the following operational effects are obtained. It should be noted that "( )" is omitted with regard to the numeral and symbol of each of the above components.

Since the second member 2 has both the recessed portions 8 and 8 which open downward and hangs downward, it has i) of the operational effects of the above first configuration. Further, since both the recessed portions 8 and 8 each have the front and rear slant faces 2FF and 2BB, they have ii) of the operational effects of the above first configuration. The hook 9B is configured not as a rotary cap but completely as a strengthening member and has a simple structure, thus obtaining iii) of the operational effects of the above first configuration. Furthermore, the fourth cross-pin P4 is a pin which is engaged later, thus having iv) of the operational effects of the above first configuration.

According to the second configuration, similarly to the above first configuration, a working machine attachment attaching and detaching device capable of attaining simple structure, low cost, high durability, automatic engagement, facilitation of alignment of a pin engaged later regardless of the size of a working machine attachment can be obtained.

Moreover, a configuration in which a remote stop pin putting in/out means for putting the stop pin in and out by remote manipulation is provided is suitable. According to this configuration, the stop pin is put in and out by remote manipulation with the remote stop pin putting in/out means, thereby enabling labor saving, improvement in safety, and high attachment and detachment efficiency.

A configuration in which the inside diameter of at least one of the first horizontal through-holes and the second horizontal through-hole is made smaller in the order of the insertion direction of the stop pin, and in which the outside diameter of the stop pin is made smaller in the order from the basic end toward the forward end thereof according to the inside diameter is suitable. According to this configuration, a stepped pin of which the outside diameter becomes smallest at the forward end is used as the stop pin, and the through-hole in which the stop pin is fitted has inside diameter matching the outside diameter of the stop pin, thus making it easy to put the stop pin in and out. Consequently, interchange operation can be performed promptly.

BRIEF DESCRIPTION OF THE DRAWINGS

FIG. 1A is an explanatory view of detachment from a working machine attachment, FIG. 1B is a view showing the completion of engagement of a third cross-pin and the process of engagement of a fourth cross-pin, and FIG. 1C is a view showing the completion of engagement of the fourth cross-pin;

FIG. 2A is a front view, and FIG. 2B is a sectional view taken along the 2B—2B line in FIG. 2A;

FIG. 3A is a view showing the start of engagement of the fourth cross-pin, and FIG. 3B is a view showing the completion of engagement of the fourth cross-pin;

FIG. 6A is a view explaining detachment from the working machine attachment, FIG. 6B is a view showing the completion of engagement of the third cross-pin, FIG. 6C is a view showing the process of engagement of the fourth cross-pin, and FIG. 6D is a view showing the completion of engagement of the fourth cross-pin;

FIG. 7A is an explanatory view of a first member and the third cross-pin before the third cross-pin is fitted in the first member, and FIG. 7B is an explanatory view of the first member and the third cross-pin when the third cross-pin has been fitted in the first member;

FIG. 9A is a view showing the completion of engagement of the third cross pin, and FIG. 9B is a view showing the process of engagement of the fourth cross-pin.

Best MODE FOR CARRYING OUT THE INVENTION

Preferred embodiments of the present invention will be described in detail below with reference to the attached drawings.

Figure 1A:
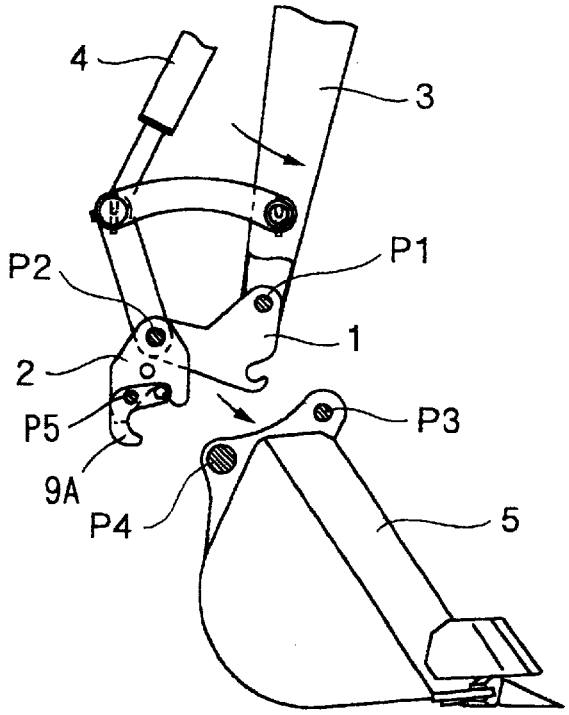
FIG. 1A to FIG. 1C are sectional side views according to a first embodiment of the present invention.

An attaching and detaching device of a first embodiment includes a first member 1 and a second member 2 as shown in FIG. 1A. The first member 1, the basic end of which is connected to the forward end of a working machine arm 3 with a first cross-pin P1, is rotatable around the first cross-pin P1 by extension and contraction of a hydraulic cylinder 4. Meanwhile, the second member 2, the basic end of which is connected to the forward end of the first member 1 with a second cross-pin P2, hangs downward. The details are as shown in FIG. 2A and FIG. 2B.

Figure 2A:
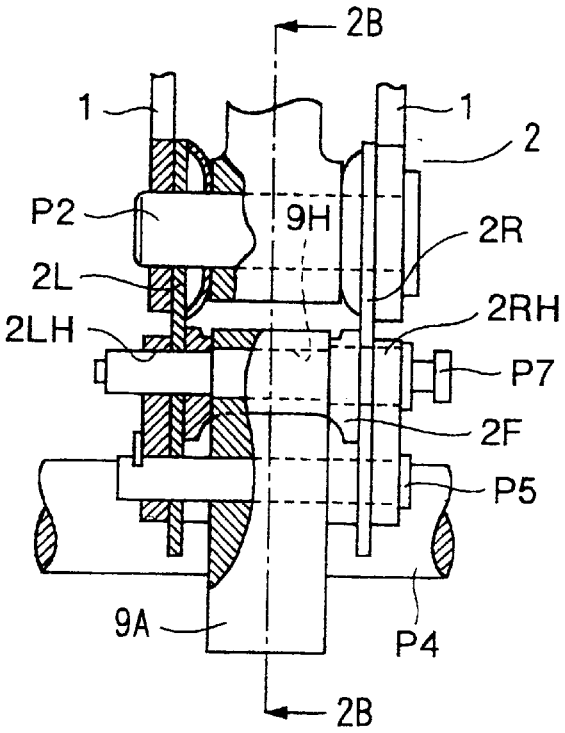
FIG. 2A and FIG. 2B are views showing a second member and its surrounding members in the first embodiment.

As shown in FIG. 2A, the second member 2 has an integral configuration in which a pair of side plates 2R and 2L are disposed opposite to each other in a transverse direction and in which both the side plates 2R and 2L are connected by welding right and left ends of a front and rear strengthening members 2F and 2B (See FIG. 2B) respectively to the sides plates 2R and 2L. The side plates 2R and 2L have first horizontal thorough-holes 2RH and 2LH respectively for inserting a stop pin P7 at the top thereof, and each have a recessed portion 8, provided with a front and rear slant faces 2FF and 2BB the opening space of which widens more toward the forward ends, at the lower face of the forward end. The side plates 2R and 2L have a hook 9A between them, almost the center of which is connected to the same plates with a fifth cross-pin P5.

Figure 2B:
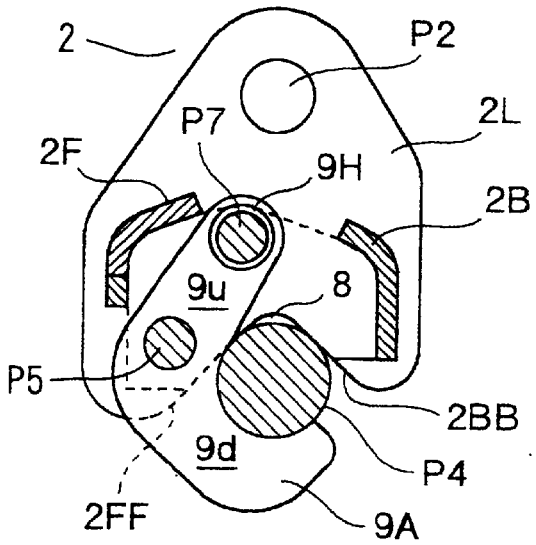

As shown in FIG. 2B, the hook 9A bends at a pin connecting portion with the fifth cross-pin P5, being divided into an upper portion and a lower portion and formed almost into an L-shape. The upper potion is a spindle portion 9*u* having a second horizontal through-hole 9H for inserting the stop pin P7, whereas the lower portion is a hook body 9*d* opening toward both the recessed portions 8 and 8. In almost the L-shape, the lower face of the spindle portion 9*u* partly protrudes from the bottoms of both the recessed portions 8 and 8, and the hook body 9*d* opens to both the recessed portions 8 and 8 side while fully opening the apertures of both the recessed portions 8 and 8 when the hook 9A is balanced rotationally around the fifth cross-pin P5 by its own weight (which corresponds to the state in FIG. 1A).

Figure 3A:
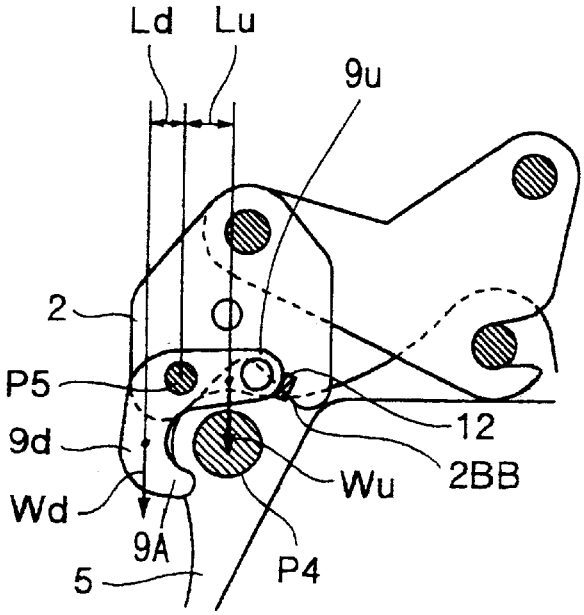
FIG. 3A and FIG. 3B are detailed explanatory views of the fourth cross-pin in the first embodiment.

The shapes and weight of the hook 9A and both the recessed portions 8 and 8, and the position of the fifth cross-pin P5 are set in such a manner that the moments around the fifth cross-pin P5 of the spindle portion 9*u* and the hook body 9*d* are as explained in FIG. 3A when the fifth cross-pin PS is inserted as illustrated between portions diagonally above both the recessed portions 8 and 8 and almost the center of the hook 9A is connected with the fifth cross-pin P5. Specifically, they are set so that the lower face of the spindle portion 9*u* partly protrudes from the bottoms of both the recessed portions 8 and 8, and so that the hook body 9*d* is balanced while opening toward both the recessed portions 8 and 8 at the same time as opening the apertures of both the recessed portions 8 and 8. Namely, "Wd×Ld=Wu×Lu", where Wd is the weight of the hook body 9*d*, Ld is a horizontal distance from the fifth cross-pin P5 to the center of gravity of the hook body 9*d*, Wu is the weight of the spindle portion 9*u*, and Lu is a horizontal distance from the fifth cross-pin PS to the center of gravity of the spindle portion 9*u*.

Meanwhile the first member 1, the second member 2, both the first horizontal through-holes 2RH and 2LH, and the second through-hole 9H are set to have the following relationship among them. The shapes and weight of the hook 9A and both the recessed portions 8 and 8, and the position of the fifth cross-pin PS are set as described above. Therefore, as shown in FIG. 1A, the lower face of the spindle portion 9*u* partly protrudes from the bottoms of both the recessed portions 8 and 8, and the hook body 9*d* is balanced while opening to both the recessed portions 8 and 8 side at the same time as opening the apertures of both the recessed portions 8 and 8. Accordingly, when a third cross-pin P3 is engaged in the vicinity of the basic end of the first member 1 (which corresponds to the state shown in FIG. 1B), lengths of the first and second members 1 and 2 can be set so that a fourth cross-pin P4 is located nearly beneath both the recessed portions 8 and 8. In the lengths thus set of the first and second members 1 and 2, after the third cross-pin P3 is engaged near the basic end of the first member 1, the hydraulic cylinder 4 is extended. This extension allows the fourth cross-pin P4 to slide up either of the front slant faces 2FF or the rear slant faces 2BB of both the recessed portions 8 and 8 to approach the bottoms of both the recessed portions 8 and 8 and at the same time abut on the lower face of the spindle portion 9*u* to boost the same.

Incidentally, also at the time of interchanging with a working machine attachment 5 (hereinafter called a bucket 5) with the distance between the third and fourth cross-pins P3 and P4 being somewhat different, since both the recessed portions 8 and 8 have the front and the rear slant faces 2FF and 2BB respectively, the fourth cross-pin P4 slides up the rear slant faces 2BB on the right side shown if the distance is short, and on the contrary, the fourth cross-pin P4 slides up the front slant faces 2FF on the left side shown if the distance is long. Namely, the above relationship is applied also to the bucket 5 with the distance between the third and fourth cross-pins P3 and P4 being somewhat different.

Figure 3B:
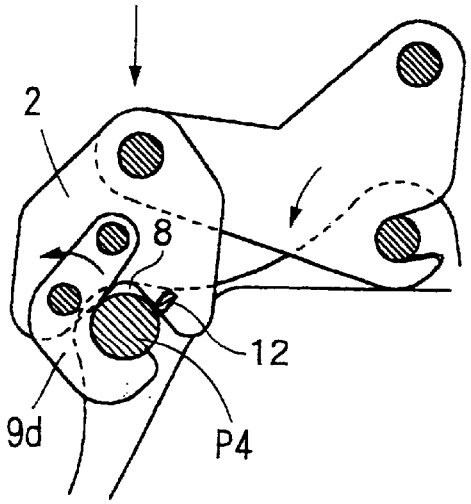

The explanation is returned where it was. The aforesaid boost causes the rotation of the hook 9A around the fifth cross-pin P5. This rotation yields the hook body 9*d* to enclose the fourth cross-pin P4 from the outsides of both the recessed portions 8 and 8 as shown in FIG. 3B. As the result of the aforesaid boost and enclosure, the fourth cross-pin 4 is put between the front slant faces 2FF, for example, of both the recessed portions 8 and 8, and the inner face of the hook body 9*d*. When the fourth cross-pin 4 is put between them, the stop pin 7 is inserted into the first and second through-holes 2RH, 2LH, and 9H. The hook 9A is fixed to the second member 2 by this insertion. Thereby, the fourth cross-pin P4 is engaged with the forward end of the second member 2 as shown in FIG. 1C. The first and second horizontal through-holes 2RH, 2LH, and 9H are set to establish the aforesaid relationship.

Aspect examples of the above first embodiment will be enumerated below.

Figure 4:
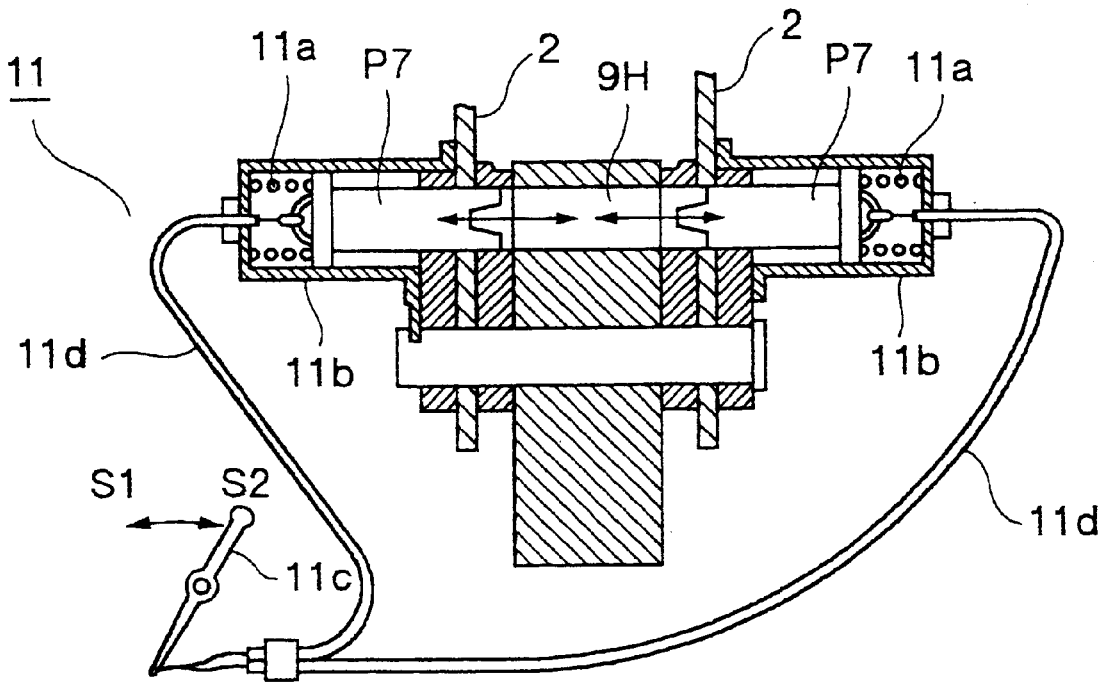
FIG. 4 is a sectional front view of a remote stop pin putting in/out means as respective first aspect examples of the first and a second embodiment.

(1) In a first aspect example, a remote stop pin putting in/out means 11 for putting the stop pin P7 in and out by remote manipulation is provided in the configuration of the first embodiment. As shown in FIG. 4, for example, the remote stop pin putting in/out means 11 has a box member 11*b* in which the second member 2 houses the rear end portion of the stop pin P7 and which contains a spring 11*a* for pushing the stop pin P7 into the second horizontal through-hole 9H, and a lever 11*c* by which the stop pin P7 can be freely pulled out of the second horizontal through-hole 9H against the push-in force of the spring 11*a* and by which the state in which the through-hole 9H is pulled out can be freely maintained. More in detail, the remote stop pin putting in/out means 11 in FIG. 4 has the stop pin P7 which is divided into a right and left parts, thereby having two box members 11*b* and two springs 11*a*. The forward ends of both cables 11*d* and 11*d* are connected to the rear ends of the stop pins P7 and P7 respectively. The basic ends of both the cables 11*d* and 11*d* are connected to one lever 11*c* provided in a driver's seat. The lever 11*c* has a first position S1 at which both the cables 11*d* and 11*d* are returned, thereby leaving both the stop pins P7 and P7 to the push-in force of the springs 11*a* and 11*a*. Further, the lever 11*a* has a second position S2 at which both the cables 11*d* and 11*d* are pulled by inclining the lever 11*c*, whereby both the stop pins P7 and P7 are pulled out of the second horizontal through-hole 9H against the push-in force of both the springs 11*a* and 11*a*. Switching of the first and second positions S1 and S2 is entrusted to the manipulation of an operator. Incidentally, the first position S1 is a position at the time of completion of engagement of the fourth cross-pin P4, and the second position S2 is a position before the engagement. Thus, the stop pin P7 can be put in and out by remote manipulation. It should be mentioned that the remote stop pin putting in/out means 11 can be made by the use of a hydraulic cylinder or a pneumatic cylinder.

Figure 5:
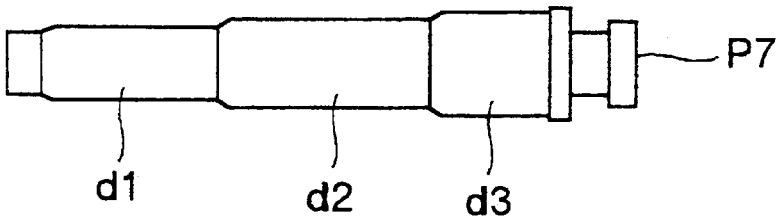
FIG. 5 is a side view of a stepped stop pin as respective second aspect examples of the first and second embodiments.

(2) In a second aspect example, as shown in FIG. 5, the stop pin P7 has a small outside diameter portion d1, a medium outside diameter portion d2, and a large outside diameter portion d3 from the forward end in order in the configuration of the first embodiment or the first aspect example. Although not illustrated, one first horizontal through-hole 2LH in which the small outside diameter portion d1 at the front end of the stop pin P7 is fitted has a small inside diameter, the second horizontal through-hole 9H in which the medium outside diameter portion d2 at the middle part of the stop pin P7 is fitted has a medium inside diameter, and the other first horizontal through-hole 2RH in which the large outside diameter portion d3 at the basic end of the stop pin P7 is fitted has a large inside diameter. Specifically, a stepped pin of which the outside diameter becomes smallest at the forward end is used as the stop pin P7, and the inside diameters of the first and second horizontal through-holes 2RH, 2LH, and 9H are changed in accordance with a change in the outside diameter of the stop pin P7, thus making it easy to put the stop pin P7 in and out.

(3) In a third aspect example, the relationship of "Wd×Ld<Wu×Lu" is suitable in the configuration of the first embodiment, the first aspect example, or the second aspect example. Specifically, as shown in FIG. 3A, in the state in which the hook body 9*d* opens toward both the recessed portions 8 and 8 while opening the apertures of both the recessed portions 8 and 8, a stopper 12 for stopping the illustrated clockwise rotation of the hook 9A is provided along the rear slant face 2BB on the right part side shown of the second member 2. As a result, even if the second member 2 swings back and forth by the extension of the hydraulic cylinder 4 and the like, for example, the fourth cross-pin P4 is quickly guided into both the recessed portions 8 and 8, thereby improving interchange efficiency.

Figure 6A:
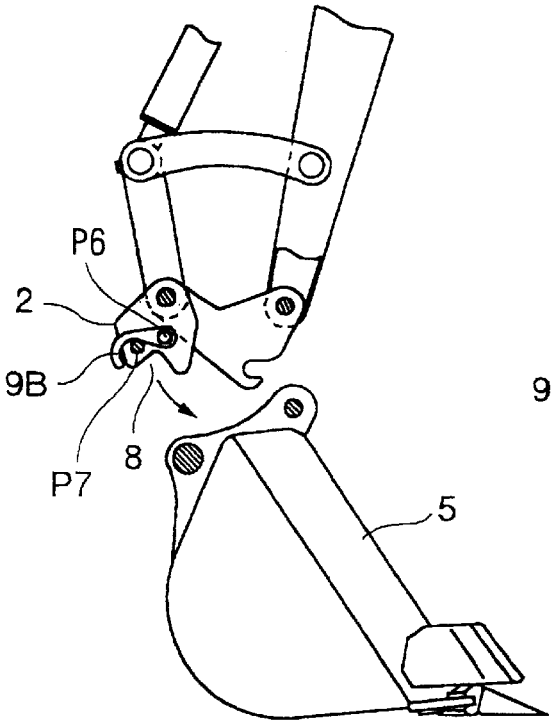
FIG. 6A to FIG. 6D are sectional side views according to the second embodiment.

As for a second embodiment, components different from those of the first embodiment will be explained. As shown in FIG. 6A, the second embodiment is configured including a hook 9B different from the hook 9A in the first embodiment. More in detail, the hook 9B, the lower portion of which opens toward both the recessed portions 8 and 8, is connected to the second member 2 at the upper end with a sixth cross-pin P6 and rotatable around the six cross-pin P6. Meanwhile, the stop pin P7 can be freely put in and out of the first horizontal through-holes 2RH and 2LH (See FIG. 2A) provided in both the side plates 2R and 2L diagonally above both the recessed portions 8 and 8.

Figure 6B:
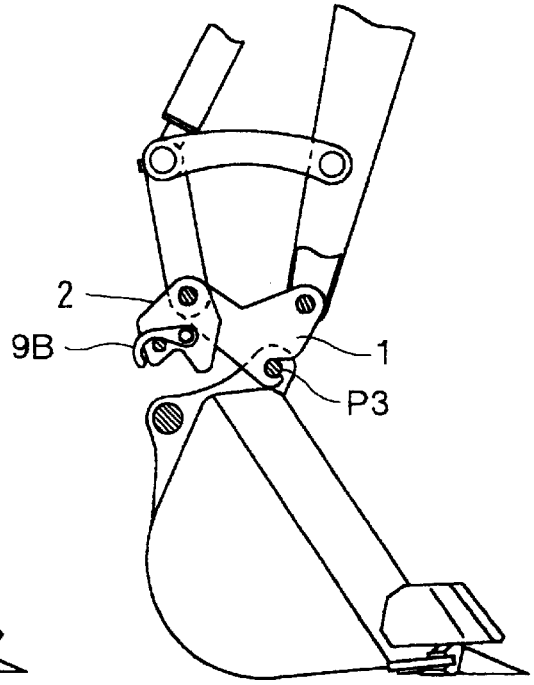
Figure 6C:
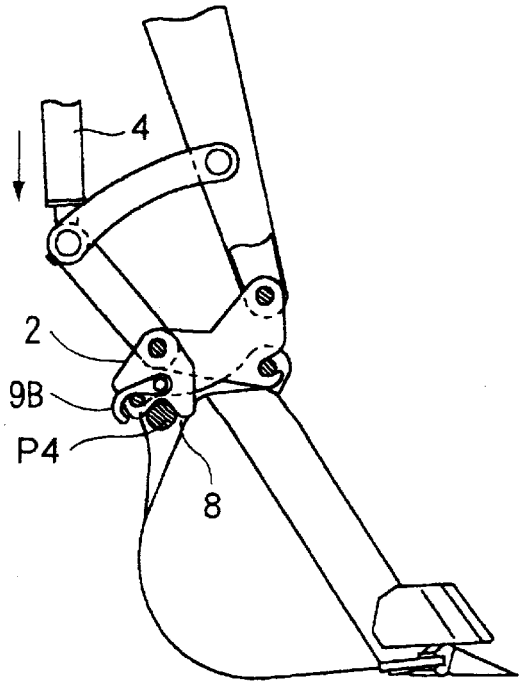
Figure 6D:
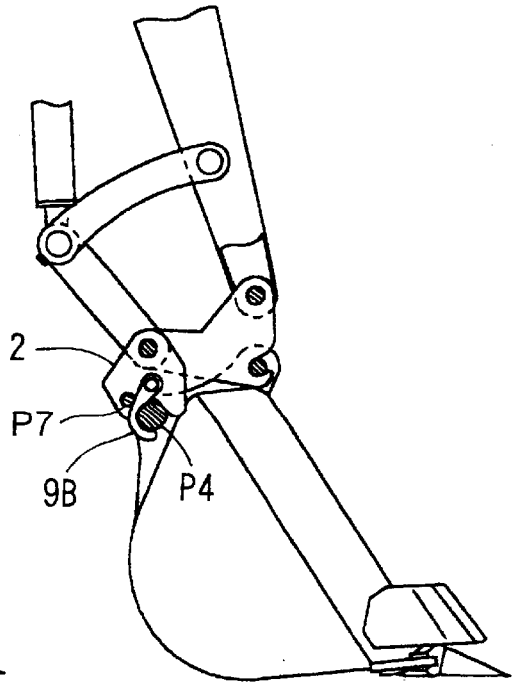

The operation of the second embodiment will be explained. Specifically, as shown in FIG. 6A, the stop pin P7 is inserted into the first horizontal through-holes 2RH and 2LH. The third cross-pin P3 is engaged near the basic end of the first member 1 as shown in FIG. 6B while the hook 9B is mounted on the stop pin P7. Thereafter, the hydraulic cylinder 4 is extended as shown in FIG. 6C. When this extension causes the fourth cross pin P4 to slide up either of the front and the rear slant faces 2FF and 2BB of both the recessed portions 8 and 8 and abut on both the front and the rear slant faces 2FF and 2BB of both the recessed portions 8 and 8, the stop pin P7 is pulled out of the first horizontal through-holes 2RH and 2LH. Subsequently, the hook 9B is rotated around the sixth cross-pin P6. When the inner face of the lower portion of the hook 9B abuts on the lower face of the fourth cross-pin P4 as shown in FIG. 6D, the stop pin P7 is reinserted into the first horizontal through-holes 2RH and 2LH. As the result of the above reinsertion, the hook 9B is fixed to the second member 2, whereby the fourth cross-pin P4 is engaged at the forward end of the second member 2. In other words, the hook 9B, the first horizontal through-holes 2RH and 2LH, and the sixth cross-pin P6 are set to accomplish the above operation.

Aspect examples of the second embodiment will be enumerated below.

(1) A first aspect example is configured similarly to the first aspect example of the first embodiment. Accordingly, the repeated explanation is omitted.

(2) A second aspect example is configured similarly to the second aspect example of the first embodiment. In the second embodiment, however, the second horizontal through-hole 9H in the first embodiment is not formed in the hook 9B. Therefore, the second aspect example is different in that the stepped stop pin P7 has a forward end portion with a small outside diameter fitting in the first horizontal through-hole 2LH with a small inside diameter, and a basic end and a middle portion each with a large outside diameter passing through and fitting in the first horizontal through-hole 2RH with a large inside diameter. It should be noted that the same second horizontal through-hole 9H as that in the first embodiment may be provided in the hook 9B, allowing the stop pin P7 to be freely put in and out. In this situation, this second aspect example has the same configuration as the second aspect example of the first embodiment.

Figure 1B:
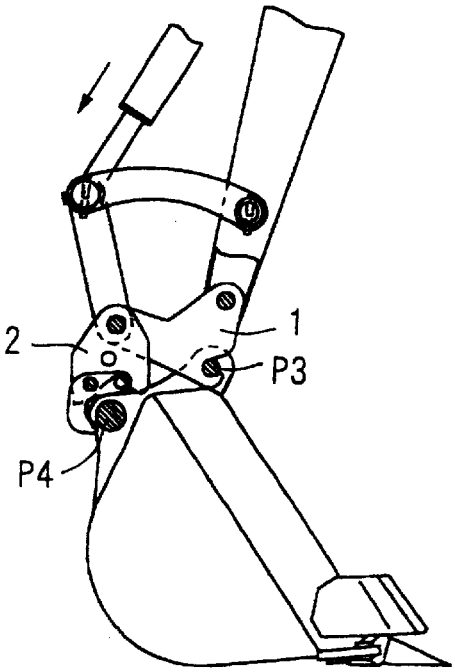
Figure 1C:
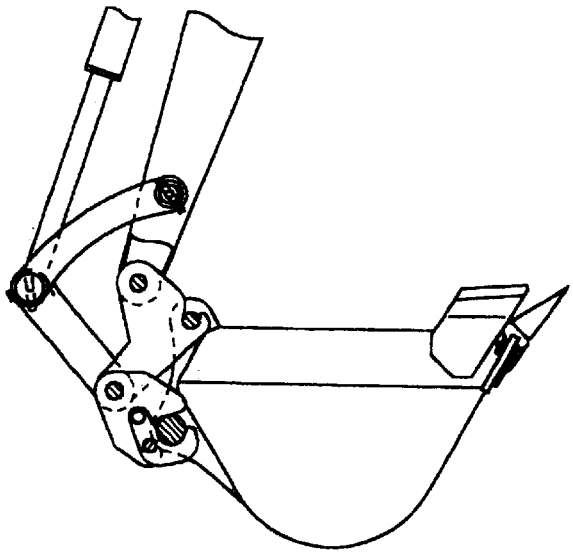

Although not described in detail in the above first and second embodiments, a mechanism engaging the third pin P3 near the basic end of the first member 1 is of a hook type as shown in FIG. 1A and FIG. 1B. In this case, it is suitable that the opening direction of the hook is set not to be the same direction as each of the opening directions of both the recessed portions 8 and 8 and the hook 9A in the state in which the fourth cross-pin P4 is engaged (for example, FIG. 1C). If the direction is set as described above, disengagement of the third cross-pin P3 during operation can be prevented. Moreover, the following configurations, for example, are also suitable.

(1) Only the mechanism engaging the third cross-pin P3 is configured to include a rotary cap as described in Japanese Utility Model Bulletin No. 3030543 which is the prior art. In this case, the mechanism is complicated by the rotary cap, thereby increasing costs. Durability including rain proof, rust proof, vibration proof, and the like is sometimes insufficient for construction equipment which operates in harsh environments.

(2) The third cross-pin P3 is configured in a conventional method, being driven into a pin boss. In this case, if the engagement of the third cross-pin P3 is the initial engagement, the degree of freedom for its alignment is high, whereby attachment and detachment efficiency never drops greatly, and besides certainty can be obtained. In the small-sized working machine attachment 5, attachment and detachment operation with high efficiency can be performed, thereby making it possible to lower costs.

Figure 7A:
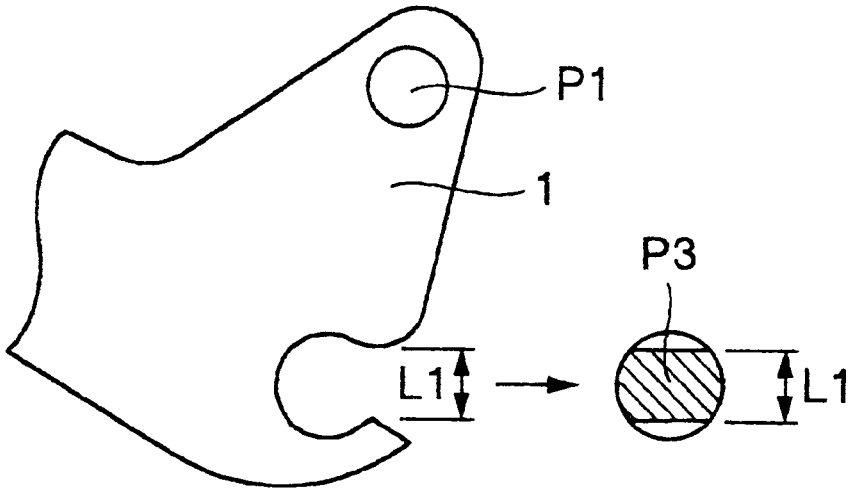
FIG. 7A and FIG. 7B are views showing other examples of configurations for preventing disengagement of the third cross-pin in the first and second embodiments.
Figure 7B:
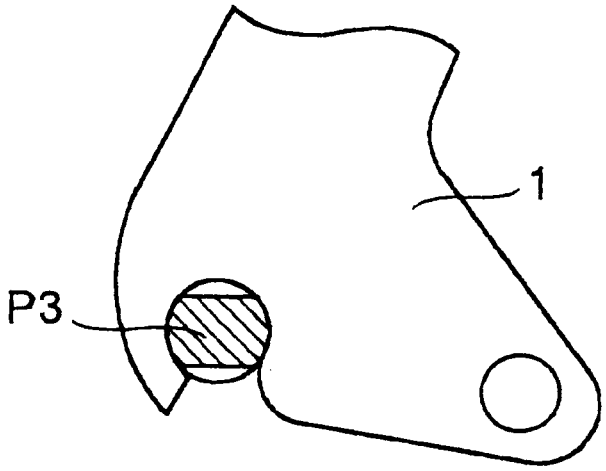
Figure 8:
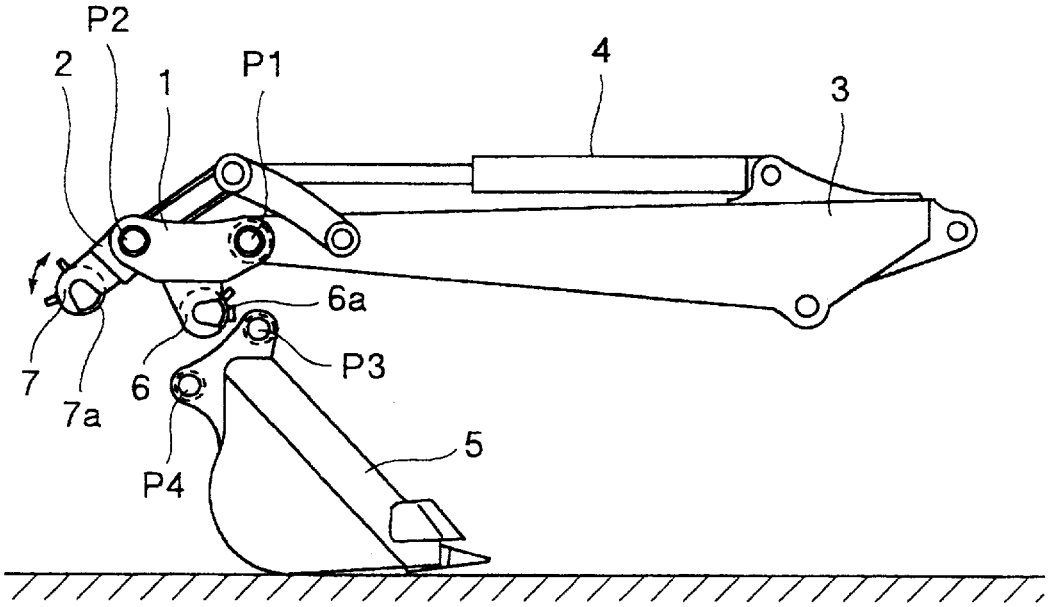
FIG. 8 PRIOR ART
FIG. 8 is a side view of a conventional working machine attachment attaching and detaching device.
Figure 9A:
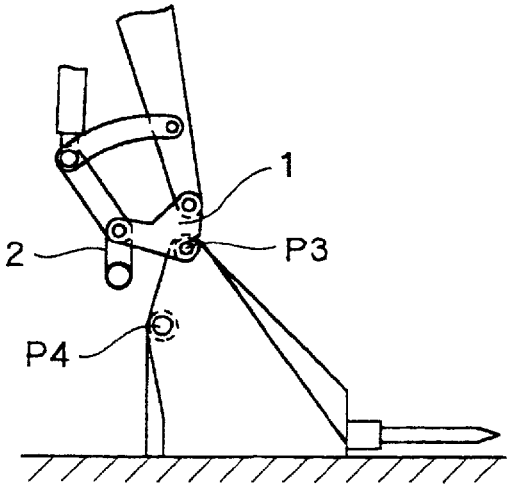
FIG.9A PRIOR ART
FIG. 9A and FIG. 9B are explanatory views for use of the conventional working machine attachment attaching and detaching device.
Figure 9B:
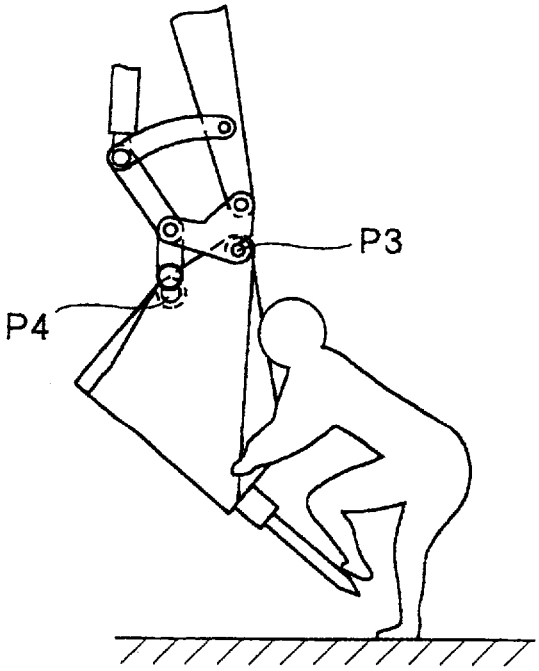
FIG.9B PRIOR ART

(3) As shown in FIG. 7A, the third cross-pin P3 except a portion fitting in a boss is cut into the same width L1 as that of a hook aperture near the basic end of the first member 1. When the third cross-pin P3 is fitted in the hook aperture, the hook aperture is brought close to the third cross-pin P3 in the direction in which the third cross-pin P3 is cut into the width L1, and the third cross-pin P3 is fitted in it. After the cross-pin P3 is fitted in the hook, the third cross-pin P3 is rotated 90 degrees relative to the hook aperture as shown in FIG. 7B to be secured. Consequently, disengagement and looseness can be prevented, and attachment and detachment are facilitated.

Further, although not described in detail in the first and second embodiments, disengagement of the third and fourth cross-pins P3 and P4 may be performed in the reverse operation to that in the first and second embodiments. In this case, as is evident from the above description "In the attachment and detachment operation of the working machine attachment 5, generally the operation during engagement (namely, during "attachment") requires more careful handling and more time than the operation during disengagement (namely, during "detachment")," the operation during disengagement can be performed more easily and in a shorter time than that during engagement. In short, in assembling and disassembling a machine, disassembly is easier than assembly.

What is claimed is:

1. A working machine attachment attaching and detaching, device including a first member and a second member, said first member having a basic end adapted to be connected to a forward end of a working machine arm with a first cross-pin, said first member being rotatable around said first cross-pin by extension and contraction of a hydraulic cylinder, said second member having a basic end connected to a forward end of said first member with a second cross-pin, a working machine attachment includes a third cross-pin and a fourth cross-pin, said first member is adapted to engage said third cross-pin near the first member basic end, and said second member is adapted to engage said fourth cross-pin at a forward end of said second member, said working machine attachment attaching and detaching device comprising:

a stop pin, a pair of side plates provided as said second member disposed opposite to each other in a transverse direction and having an integral configuration, wherein each of said side plates has a first horizontal through-hole for inserting said stop pin, and a recessed portion provided with front and rear slant faces forming an opening space which widens more toward a forward end, a fifth cross-pin located between said side plates, and a hook which is connected near its center with said fifth cross-pin, wherein said hook has a bend at a connecting portion with said fifth cross-pin, dividing it into an upper portion and a lower portion and forming it into an L-shape, said upper portion being a spindle portion having a second horizontal through-hole for inserting said stop pin, said lower portion being a hook body which opens to said recessed portions, said L-shape being formed such that a lower face of said spindle portion partly protrudes from bottoms of said recessed portions, and said hook body opens to said recessed portions to fully open the recessed portions when said hook is balanced rotationally around said fifth cross-pin by its own weight, and wherein said first and second members and said first and second horizontal through-holes are configured such that said fourth cross-pin is located beneath both said recessed portions when said third cross-pin is engaged to the basic end of said first member, said machine attachment device further comprising;

said fourth cross-pin adapted to abut either of said front or rear slant faces and slide up the same after the engagement of said third cross-pin, and when said hydraulic cylinder is extended, said fourth cross-pin approaches a bottom of said recessed portions while also abutting the lower face of said spindle portion causing the rotation of said hook around said fifth cross-pin, this rotation yielding said hook body to enclose said fourth cross-pin from lower sides of said recessed portions, said enclosing enabling said stop pin to be inserted into said first and second horizontal through-holes, this insertion fixing said hook to said second member, thereby engaging said fourth cross-pin at the forward end of said second member.

2. A working machine attachment attaching and detaching device including a first member and a second member, said first member having a basic end adapted to be connected to a forward end of a working machine arm including a first cross-pin said first member being rotatable around said first cross-pin by extension and contraction of a hydraulic cylinder, said second member having a basic end connected to a forward end of said first member with said second member having a second cross-pin, said attachment device including a third cross-pin and a fourth cross-pin, said first member adapted to engage said third cross-pin near the first member basic end and said second member being adapted to engage said fourth cross-pin at a forward end of said second member, said working machine attachment attaching and detaching device comprising:

a stop pin, a pair of side plates provided as said second member disposed opposite to each other in a transverse direction and having an integral configuration, wherein each of said side plates has a first horizontal through-hole for inserting said stop pin, and a recessed portion provided with front and rear slant faces forming an opening space which widens more toward a forward end, a sixth cross-pin located between said side plates, and a hook having an upper end which is connected between said side plates with said sixth cross-pin, wherein said hook opens to said recessed portions, and wherein said hook, said first horizontal through holes, and said sixth cross-pin are configured to be connected such that said recessed portions are fully open when said hook is mounted on said stop pin which is mounted in said first horizontal through-holes, said machine attachment device further comprising:

said fourth cross-pin located beneath said recessed portions when said third cross-pin is engaged near the basic end of said first member while said hook is mounted on said stop pin, and said fourth cross-pin adapted to abut either of said front or rear slant faces of said recessed portions and slide up the same after the engagement of said third cross-pin and when said hydraulic cylinder is extended, said fourth cross-pin adapted to abut on said both front and rear slant faces and said hook adapted to rotate around said sixth cross-pin when said stop pin is pulled out of said first horizontal through-holes, said hook adapted to be fixed to said second member, and engaging with said fourth cross-pin, at the forward end of said second member, when said stop pin is reinserted into said first horizontal through-holes when the inner face of said hook abuts on the lower face of said fourth cross-pin.

3. The working machine attachment attaching and detaching device in accordance with claim 1 or claim 2, further comprising:

a remote stop pin moving means for moving said stop pin in and out by remote manipulation.

4. The working machine attachment attaching and detaching device in accordance with claim 1 or claim 2, wherein an inside diameter of at least one of said first horizontal through-holes and said second horizontal through-hole decreases, as viewed in an insertion direction of said stop pin, and wherein an outside diameter of said stop pin decreases as viewed toward a first inserted end thereof, said decreasing outside diameter substantially corresponding to said decreasing inside diameter.

5. The working machine attachment attaching and detaching device in accordance with claim 3, wherein an inside diameter of at least one of said first horizontal through-holes and said second horizontal through-hole decreases as viewed in an insertion direction of said stop pin, and wherein an outside diameter of said stop pin decreases as viewed toward a first inserted end thereof, said decreasing outside diameter substantially corresponding to said decreasing inside diameter.

* * * * *